US011150045B1

(12) United States Patent
Oglesby

(10) Patent No.: US 11,150,045 B1
(45) Date of Patent: Oct. 19, 2021

(54) SUPPRESSOR HEAT SHIELDING SYSTEM

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 0 days.

(21) Appl. No.: 15/930,552

(22) Filed: May 13, 2020

Related U.S. Application Data

(60) Provisional application No. 62/847,229, filed on May 13, 2019.

(51) Int. Cl.
*F41A 21/32* (2006.01)
*F41A 21/30* (2006.01)
*F41A 13/12* (2006.01)

(52) U.S. Cl.
CPC ..... *F41A 21/30* (2013.01); *F41A 13/12* (2013.01); *F41A 21/325* (2013.01)

(58) Field of Classification Search
CPC ..... F41A 21/30; F41A 21/32; F41A 21/325; F41A 21/34; F41A 21/36; F41A 21/38; F41A 13/12; F41C 9/06
USPC ..... 89/14.4, 14.2, 14.3; 42/1.14
See application file for complete search history.

(56) References Cited

U.S. PATENT DOCUMENTS

| | | | | |
|---|---|---|---|---|
| 9,476,662 | B2 * | 10/2016 | Fischer | F41A 21/30 |
| 9,658,010 | B1 * | 5/2017 | Oglesby | F41C 23/16 |
| 10,001,340 | B1 * | 6/2018 | Oglesby | F41C 23/16 |
| 10,126,084 | B1 * | 11/2018 | Oglesby | F41A 21/30 |
| 10,371,476 | B1 * | 8/2019 | Oglesby | F41A 21/30 |
| 10,480,885 | B2 * | 11/2019 | Mohler | F41A 21/30 |
| 2018/0164065 | A1 * | 6/2018 | Mohler | F41A 21/30 |

FOREIGN PATENT DOCUMENTS

WO WO-2020123878 A1 * 6/2020 ..... F41A 21/32

* cited by examiner

*Primary Examiner* — Jonathan C Weber
(74) *Attorney, Agent, or Firm* — Shaddock Law Group, PC

(57) ABSTRACT

A suppressor heat shielding system, including at least some of a suppressor heat shield having an internal cavity sized to allow at least a portion of a suppressor to be at least partially contained therein, wherein a sealed heat shield cavity is formed between at least a portion of an interior surface and at least a portion of an exterior surface of the suppressor heat shield, and wherein a vacuum is created within the heat shield cavity; an externally threaded support ring attached or coupled to a first end of the suppressor heat shield, wherein one or more support ring air gaps are formed through the support ring element; a heat shield cap having one or more gas apertures formed therethrough abutted against a second end of the suppressor heat shield; and a heat shield nut abutted against at least a portion of the heat shield cap.

20 Claims, 4 Drawing Sheets

SUPPRESSOR HEAT SHIELDING SYSTEM

This patent application claims the benefit of U.S. Patent Application No. 62/847,229, filed May 13, 2019, the disclosure of which is incorporated herein in its entirety by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of firearms. More specifically, the present disclosure relates to suppressor heat shields or suppressor elements for firearms.

2. Description of Related Art

A suppressor or silencer is a device that is typically attached to or an integral part of a barrel of a firearm or air gun. The suppressor acts to reduce the amount of noise and visible muzzle flash generated when a firearm is fired. Suppressors are typically constructed of a metal cylinder with internal baffles to reduce the sound of firing by slowing and cooling the rapidly expanding gases from the firing of a cartridge through a series of chambers. Because the propellant gases exits the suppressor over a longer period of time and at a greatly reduced velocity, a reduced noise signature is produced.

Typically, suppressors are integral to the firearm's barrel, directly threaded to the barrel of the firearm (via interaction of an internally threaded portion of the suppressor and an externally threaded portion of the exterior of the barrel), or are attached or coupled to a "quick-detach" flash hider or other muzzle device (which typically includes a locking mechanism that allows the suppressor to be quickly installed or removed from the firearm).

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, suppressors are typically a hollow metal tube manufactured from steel, aluminum, or titanium with various baffles inserted therein to create a number of expansion chambers. Unfortunately, heat is created during a firearm firing sequence and any attached suppressor can become extremely hot during the firing sequence. Known suppressors can produce an extremely high heat signature and are not often efficient in dissipating heat, particularly if a fabric cover is placed over the suppressor to reduce the heat signature of the suppressor or protect the user from being burned by the suppressor.

The present disclosure comprises various embodiments of a suppressor heat shielding system that provides a thermal barrier and/or heat extraction system for at least a portion of a suppressor. In certain exemplary, nonlimiting embodiments, the suppressor heat shielding system utilizes a support ring comprising two mateable support ring elements. The two halves of the support ring are aligned with and fit around a support ring registration notch formed in an external portion of a suppressor. The support ring elements include external threads that are aligned such that a suppressor heat shield can be threadedly attached or coupled to the aligned support ring elements (by interaction of the external threads of the support ring elements and internal threads of an internally threaded portion of the suppressor heat shield).

Inwardly extending protrusions of the support ring elements provide a support ring air gap between an exterior surface of the suppressor and an interior surface of the suppressor heat shield.

In various exemplary embodiments, the suppressor heat shield is substantially cylindrical (while not exclusively cylindrical) and includes a sealed heat shield cavity formed between at least a portion of the interior surface and the exterior surface of the suppressor heat shield. A vacuum is created within the heat shield cavity. By including a vacuum within the heat shield cavity, a thermal or heat transfer barrier is created between the interior surface and the exterior surface of the suppressor heat shield.

A heat shield cap and heat shield nut are used to threadedly attach or secure the second end of the suppressor heat shield to a suppressor core, extending from an attached suppressor.

Gas apertures are formed through the heat shield cap. Thus, air is able to flow through the internal cavity of the suppressor heat shield, via the support ring air gaps and the gas apertures of the heat shield cap. By allowing air to flow through the heat shield cavity, heat that becomes built up within the heat shield cavity is able to radiate through the support ring air gap and the gas apertures to the exterior environment of the suppressor heat shield.

In various exemplary, nonlimiting embodiments, the present disclosure comprises a suppressor heat shielding system comprising a suppressor heat shield extending from an open first end to an open second end and having an internal cavity, wherein the internal cavity is sized to allow at least a portion of a suppressor to be at least partially contained within the internal cavity, wherein a sealed heat shield cavity is formed between at least a portion of an interior surface and at least a portion of an exterior surface of the suppressor heat shield, and wherein a vacuum is created within the heat shield cavity; an externally threaded support ring attached or coupled to the first open end of the suppressor heat shield, wherein one or more support ring air gaps are formed through the support ring element; a heat shield cap abutted against the open second end of the suppressor heat shield, wherein one or more gas apertures are formed through the heat shield cap; and a heat shield nut abutted against at least a portion of the heat shield cap.

In various exemplary, nonlimiting embodiments, the externally threaded support ring comprises two aligned externally threaded support ring elements.

In various exemplary, nonlimiting embodiments, the suppressor heat shield is formed of stainless steel.

In various exemplary, nonlimiting embodiments, the suppressor heat shielding system further comprising a heat shield cover positioned around at least a portion of the suppressor heat shield, wherein the heatshield cover is at least partially attached to a handguard.

In various exemplary, nonlimiting embodiments, each of the support ring elements includes one or more inwardly extending protrusions that extend from the support ring element, away from the external threads and wherein each of the one or more gas apertures is formed at least partially between the one or more inwardly extending protrusions.

In various exemplary, nonlimiting embodiments, the support ring elements are aligned with a support ring registration notch formed in at least a portion of a suppressor and positioned such that terminating end portions of the inwardly extending protrusions are seated within at least a portion of the support ring registration notch.

In various exemplary, nonlimiting embodiments, at least a portion of the suppressor heat shield is double-walled.

In various exemplary, nonlimiting embodiments, the one or more gas apertures are formed so as to be aligned with one or more suppressor gas apertures of a suppressor.

In various exemplary, nonlimiting embodiments, the present disclosure comprises a suppressor heat shielding system comprising a suppressor heat shield having an internal cavity formed therethrough, wherein the internal cavity is sized to allow at least a portion of a suppressor to be positioned within the internal cavity, wherein the suppressor heat shield includes a sealed heat shield cavity formed therein, and wherein a vacuum is created within the heat shield cavity; an externally threaded support ring threadedly attached or coupled to an open first open end of the suppressor heat shield, wherein one or more support ring air gaps are formed through the support ring element; a heat shield cap abutted against an open second end of the suppressor heat shield, wherein one or more gas apertures are formed through the heat shield cap; and a heat shield nut abutted against at least a portion of the heat shield cap.

In various exemplary, nonlimiting embodiments, the present disclosure comprises a suppressor heat shielding system comprising a suppressor heat shield having an internal cavity formed therethrough, wherein the internal cavity is sized to allow a suppressor to be positioned within the internal cavity, wherein the suppressor heat shield includes a sealed heat shield cavity formed therein, wherein a vacuum is created within the heat shield cavity, and wherein an internally threaded portion is formed in a portion of the suppressor heat shield extending from an open first end of the suppressor heat shield; and an externally threaded support ring threadedly attached or coupled to the internally threaded portion of the suppressor heat shield, wherein one or more support ring air gaps are formed through the support ring element.

In various exemplary, nonlimiting embodiments, the suppressor heat shielding system further comprising a heat shield cap abutted against an open second end of the suppressor heat shield, wherein one or more gas apertures are formed through the heat shield cap.

In various exemplary, nonlimiting embodiments, the suppressor heat shielding system further comprising a heat shield nut abutted against at least a portion of the heat shield cap.

In various exemplary, nonlimiting embodiments, the suppressor heat shielding system further comprising a heat shield cover positioned around at least a portion of the suppressor heat shield, wherein the heatshield cover is at least partially attached to a handguard.

In various exemplary, nonlimiting embodiments, the externally threaded support ring comprises two aligned externally threaded support ring elements.

In various exemplary, nonlimiting embodiments, the suppressor heat shield is formed of stainless steel.

In various exemplary, nonlimiting embodiments, the suppressor heat shielding system further comprises a heat shield cover positioned around at least a portion of the suppressor heat shield, wherein the heatshield cover is at least partially attached to a handguard.

Accordingly, the present disclosure provides a suppressor heat shielding system that provides suppressor cooling and heat shielding for a firearm.

The present disclosure separately and optionally provides a suppressor heat shield that surrounds at least a portion of a suppressor so there is a reduced heat build up to the suppressor.

The present disclosure separately and optionally provides a suppressor heat shield that the heat shield cavity having a vacuum.

The present disclosure separately and optionally provides a suppressor heat shielding system that allows for increased cooling so that the potential of damaging the contained or partially contained suppressor because of excess heat is reduced.

The present disclosure separately and optionally provides a suppressor heat shielding system that provides for a decreased heat signature from a suppressor.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures.

While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF THE PRESENT DISCLOSURE

Figure 1:
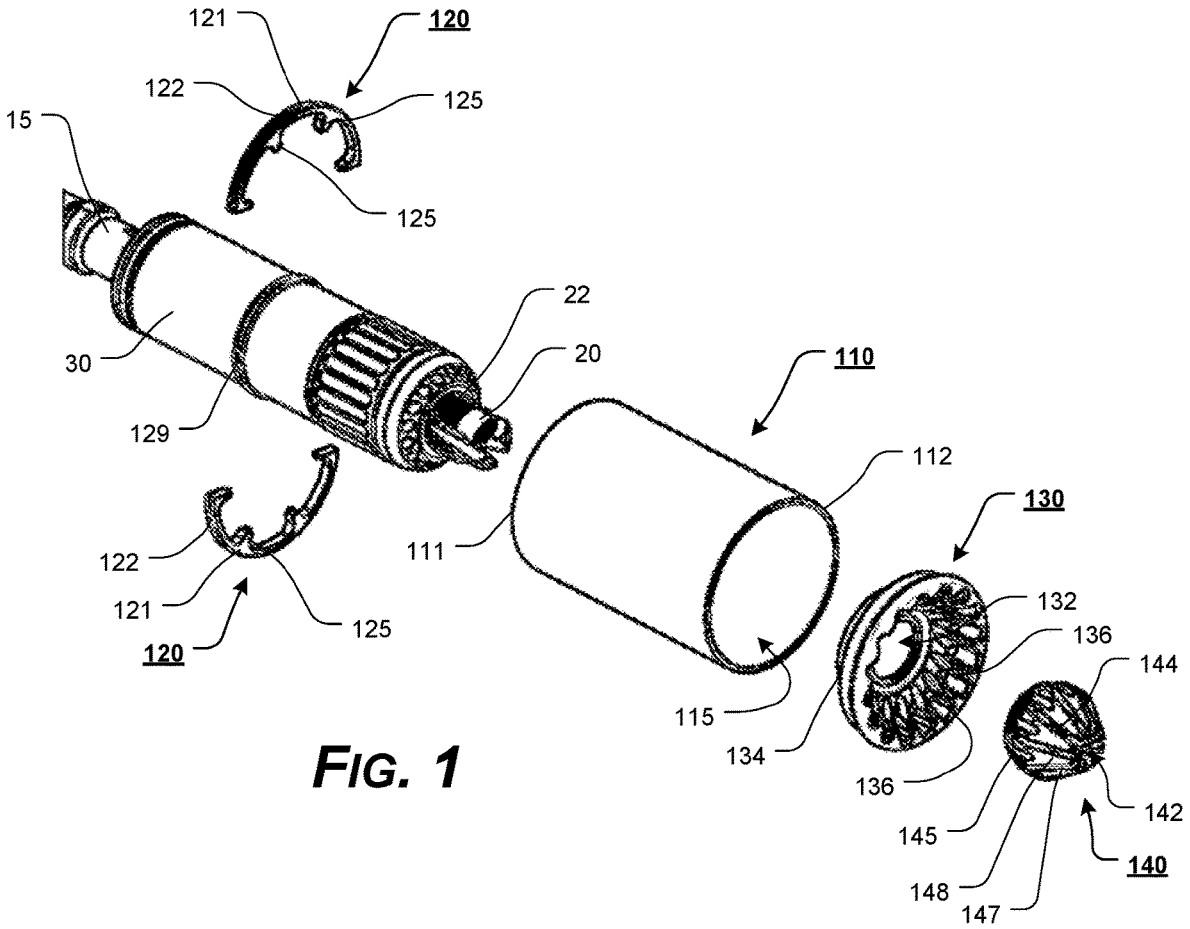
FIG. 1 illustrates an exploded, upper, front perspective view of an exemplary components of a suppressor heat shielding system positioned relative to a suppressor and suppressor core, according to the present disclosure.
Figure 2:
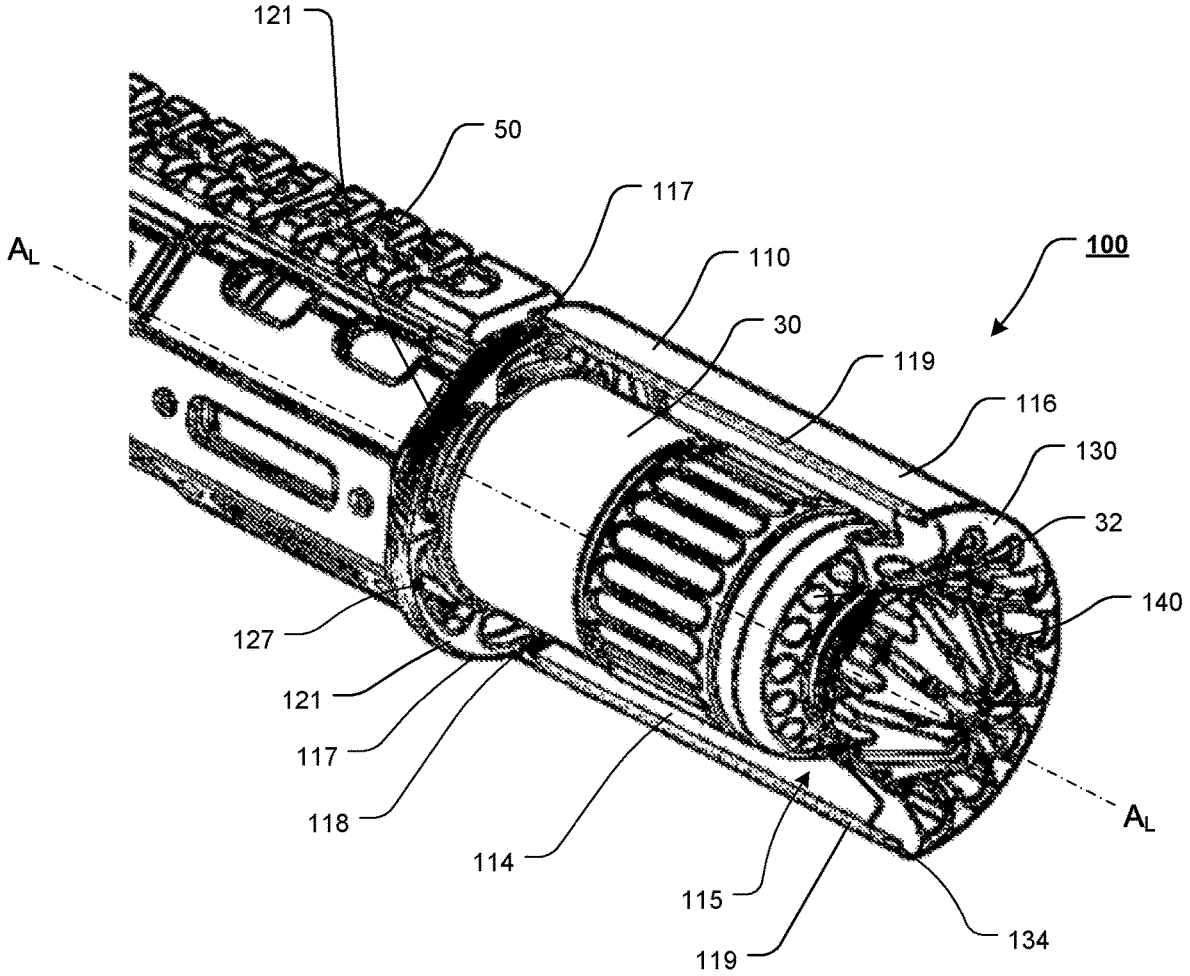
FIG. 2 illustrates a partially exploded upper, front perspective view of an exemplary embodiment of a suppressor heat shielding system attached or coupled to an exemplary suppressor, according to the present disclosure.
Figure 3:
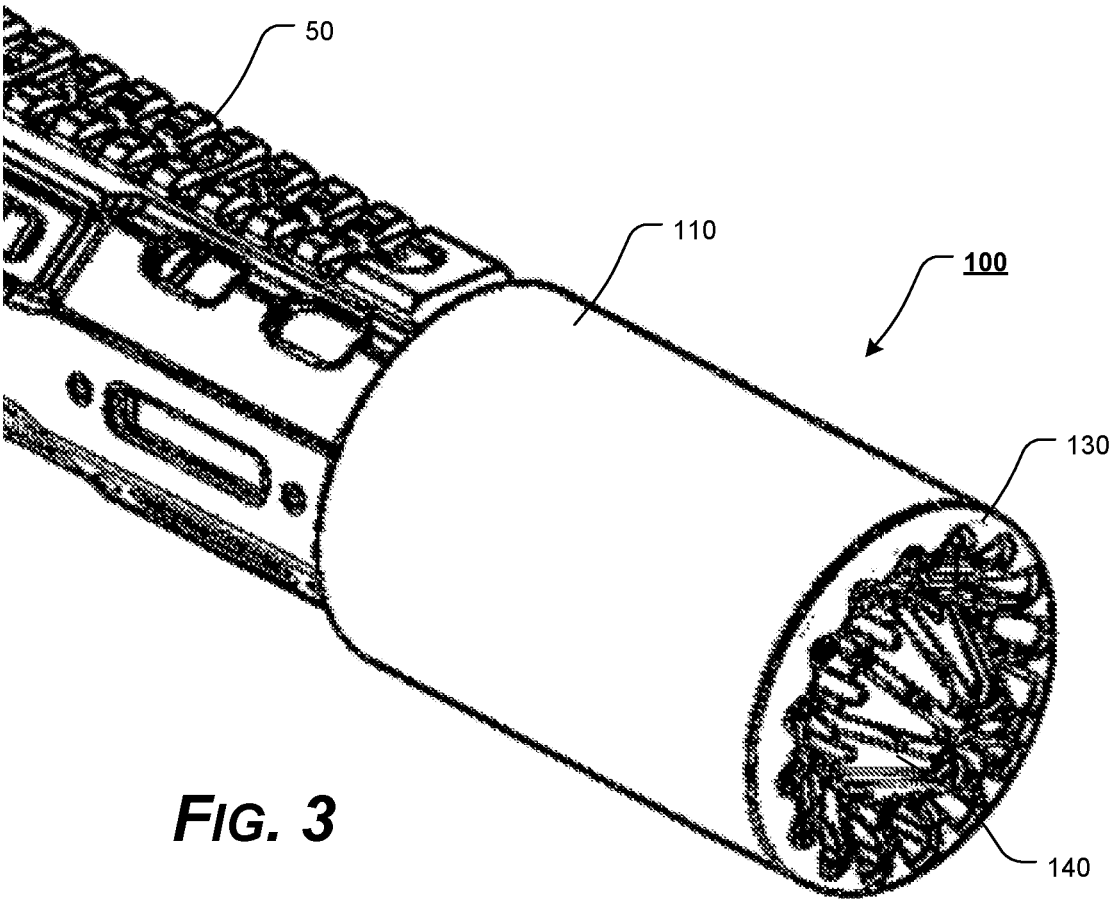
FIG. 3 illustrates an upper, front perspective view of an exemplary embodiment of a suppressor heat shielding system attached or coupled to an exemplary suppressor, according to the present disclosure.

For simplicity and clarification, the design factors and operating principles of the suppressor heat shielding system and/or the suppressor heat shield according to the present disclosure are explained with reference to various exemplary embodiments of a suppressor heat shielding system and/or suppressor heat shield according to the present disclosure. The basic explanation of the design factors and operating principles of the suppressor heat shield and/or the suppressor heat shielding system is applicable for the understanding, design, and operation of the present disclosure. It should be appreciated that the present disclosure can be adapted to many applications where heat shielding and/or thermal venting can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "suppressor heat shielding system", "suppressor heat shield", "suppressor cover", "heat shield", "suppressor", and "suppressor core" are used for basic explanation and understanding of the operation of the systems, methods, and apparatuses of the present disclosure. Therefore, the terms "suppressor heat shielding system", "suppressor heat shield", "suppressor cover", "heat shield", "suppressor", and "suppressor core" are not to be construed as limiting the systems, methods, and apparatuses of the present disclosure. Thus, for example, the terms "suppressor heat shield" and "suppressor heat shielding system" are to be understood to broadly include any elongate, hollow portion of material capable of being attached or coupled to an object.

For simplicity and clarification, the suppressor heat shielding system and/or the suppressor heat shield of the present disclosure will be described as being used in conjunction with a suppressor having a suppressor core at least partially extending from the suppressor. However, it should be appreciated that these are merely exemplary embodiments of the suppressor heat shielding system and/or the suppressor heat shield and are not to be construed as limiting the present disclosure.

Turning now to the drawing FIGS., FIGS. 1-5 illustrates certain components of an exemplary suppressor heat shielding system 100 and suppressor heat shield 110, according to the present disclosure.

The suppressor heat shielding system 100 and/or the suppressor heat shield 110 are shown and described as being used in conjunction with a rifle barrel 15 at least partially enclosed within a handguard 50. A suppressor core 20 is permanently or removably attached or coupled to the barrel 15, in a manner similar to the attachment or coupling of a muzzle device. The suppressor core 20 includes an externally threaded portion forming suppressor core external threads 22. A suppressor 30 is threadedly attached or coupled to the suppressor core 20, such that at least a portion of the suppressor core external threads 22 of the suppressor core 20 extends beyond the suppressor 30.

The suppressor 30 optionally includes suppressor gas apertures 32 formed in a front portion of the suppressor 30. The suppressor gas apertures 32 allow at least some blast or propellant gases to be expelled through the suppressor gas apertures 32.

A more detailed explanation of the components of the firearm, barrel 15, handguard 50, suppressor core 20, and suppressor 30, instructions regarding how to attach and/or remove the various components and other items and/or techniques necessary for the implementation and/or operation of the various components of the rifle platform are not provided herein because such components are commercially available and/or such background information will be known to one of ordinary skill in the art. Therefore, it is believed that the level of description provided herein is sufficient to enable one of ordinary skill in the art to understand and practice the present disclosure as described.

FIGS. 1-5 illustrate certain elements and/or aspects of an exemplary embodiment of a suppressor heat shielding system 100 and/or suppressor heat shield 110, according to the present disclosure. As illustrated in FIGS. 1-5, the suppressor heat shielding system 100 comprises at least some of a suppressor heat shield 110, a support ring 120, a heat shield cap 130, and a heat shield nut 140.

The suppressor heat shield 110 comprises an elongate, substantially tubular member extending, along a longitudinal axis, $A_L$, from an open receiver end or first end 111 to an open muzzle end or second end 112. While illustrated as having a substantially circular cross-section (when viewed perpendicular to the longitudinal axis, $A_L$), it is to be distinctly understood that the suppressor heat shield 110 may have any desired cross-sectional shape. Thus, while a substantially cylindrical outer shape would allow for ease in manufacturing and would conform with the customary use of essentially cylindrically shaped suppressors, the shape of the suppressor heat shield 110 is not limited to being substantially cylindrical and, for example, may have a substantially circular, oval, oblong, triangular, square, rectangular, hexagonal, octagonal, or other geometrically non-geometric shape.

The suppressor heat shield 110 includes an exterior surface 116 and an interior surface 114. The interior surface 114 defines an internal cavity 115 of the suppressor heat shield 110 substantially between the first end 111 and the second end 112. An internally threaded portion 117 extends from the first end 111 to an internal projection that forms a heat shield shoulder 118. The heat shield shoulder 118 extends from the interior surface 114 of the suppressor heat shield 110 into at least a portion of the internal cavity 115.

A heat shield cavity 119 is formed between the interior surface 114 and the exterior surface 116 of the suppressor heat shield 110. Thus, at least a portion of the suppressor heat shield 110 is comprised of a double-walled, substantially tubular suppressor heat shield 110. A vacuum is created within the heat shield cavity 119 to create a vacuum airgap between the interior surface 114 and the exterior surface 116 of the suppressor heat shield 110. By incorporating a deep, shaped vacuum within the heat shield cavity 119, a thermal insulator is provided to block the conductive transfer of heat or thermal energy from the internal cavity 115 of the suppressor heat shield 110 to the exterior surface 116 of the suppressor heat shield 110. When heat is conducted from the interior surface 114 to the heat shield cavity 119, the vacuum does not provide any molecules to carry the heat energy across the heat shield cavity 119. Thus, the transfer of heat across the heat shield cavity 119 to the exterior surface 116 is greatly reduced. So, while heat can be generated within the internal cavity 115, the thermal barrier created by the heat shield cavity 119 does not allow heat (or only allows a minimal amount of heat) to be transferred to the exterior surface 116 of the suppressor heat shield 110.

The suppressor heat shielding system 100 utilizes a support ring 120 comprising two mateable support ring elements 121. In various exemplary embodiments, each support ring element 121 comprises a crescent or arc shape that forms half of a circle and is a mirror image of the other support ring element 121. Alternatively, the support ring elements 121 can be formed such that one support ring element 121 forms more of the arcuate circle than the other support ring element 121, but, when aligned together, form an entire circular support ring 120.

Each support ring element 121 includes external threads 122 formed in the arcuate exterior surface of the support ring element 121. The two working elements are aligned with one another and fit around a support ring registration notch 129 formed in an external portion of a suppressor 30.

The support ring elements 121 include one or more inwardly extending protrusions 125 that extend from the support ring elements 121, away from the external threads 122.

The support ring elements 121 include external threads 122 that are aligned such that a suppressor heat shield 110 can be threadedly attached or coupled to the aligned support ring elements 121 (by interaction of the external threads 122 of the support ring elements 121 and internal threads of an internally threaded portion 117 of the suppressor heat shield 110).

Inwardly extending protrusions 125 of the support ring elements 121 provide a support ring air gap 127 between an exterior surface of the suppressor 30 and an interior surface 114 of the suppressor heat shield 110.

A heat shield cap 130 includes an internal aperture 132 formed so as to allow a portion of the suppressor core 20 (including the suppressor core external threads 22) to pass therethrough. The heat shield cap 130 includes a cap shoulder 134 that is formed so as to be aligned with and abutted against the second end 112 of the suppressor heat shield 110. In various exemplary embodiments, a plurality of gas apertures 136 are formed through the heat shield cap 130. The gas apertures 136 are formed so as to be aligned with certain of the suppressor gas apertures 32 of the suppressor 30. In this manner, blast or propellant gases that are expelled from the suppressor gas apertures 32 can exit through aligned or partially adjacent gas apertures 136 of the heat shield cap 130.

The gas apertures 136 formed through the heat shield cap 130 also allow air to flow through the internal cavity 115 of the suppressor heat shield 110, via the support ring air gaps 127 and the gas apertures 136 of the heat shield cap 130. By allowing air to flow through the heat shield cavity 119, heat that is built up within the heat shield cavity 119 is able to radiate through the support ring air gap 127 and the gas apertures 136 to the exterior environment of the suppressor heat shield 110.

A central borehole 142 extends through the heat shield nut 140, generally along the longitudinal axis, $A_L$, of the heat shield nut 140. The central borehole 142 has a central borehole diameter. Typically, the central borehole diameter is sufficient to allow the caliber of round with which the suppressor heat shielding system 100 is to be utilized to safely pass through the central borehole 142. Thus, it should be appreciated that the diameter of the central borehole 142 is a design choice based upon the size of the projectile or caliber of weapon or other device with which the heat shielding system is to be utilized.

An internally threaded recess 144 extends along the central borehole 142 from the first end of heat shield nut 140. The internally threaded recess 144 is adapted to interact with at least a portion of suppressor core external threads 22 and allow the heat shield nut 140 to be threadedly attached to a portion of the suppressor core 20.

A nut shoulder 145 extends from a portion of the heat shield nut 140. The nut shoulder 145 is formed so as to be abutted against a portion of the heat shield cap 130 adjacent the internal aperture 132 of the heat shield cap 130.

In various exemplary embodiments, the heat shield nut 140 includes longitudinally, spirally, or helically extending slots 147 that form or define side walls of forwardly extending elongated members or prongs 148. Each prong 148 is offset from and separated from each adjacent prong 148 by the longitudinally, spirally, or helically extending slots 147. It should be appreciated that the heat shield nut 140 may comprise any desired number of slots 147 and prongs 148. Thus, the number of slots 147 and prongs 148 is a design choice based upon the desired functionality and/or appearance of the suppressor heat shielding system 100.

In various exemplary embodiments, various components of the suppressor heat shielding system 100 are substantially rigid and are formed of stainless steel. Alternate materials of construction of the various components of the suppressor heat shielding system 100 may include one or more of the following: steel, aluminum, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the suppressor heat shielding system 100 is a design choice based on the desired appearance and functionality of the suppressor heat shielding system 100.

It should also be understood that the overall size and shape of the suppressor heat shielding system 100 and the various portions thereof is a design choice based upon the desired functionality and/or appearance of the suppressor heat shielding system 100.

During installation, the support ring elements 121 are aligned with the support ring registration notch 129 and positioned such that terminating ends of the inwardly extending protrusions 125 are seated within at least a portion of the support ring registration notch 129. The drawing FIGS. illustrate the port ring registration notch as being positioned substantially central to the suppressor 30. In this exemplary embodiment, the support ring registration notch 129 is positioned substantially central to the suppressor 30, as a rear portion of the suppressor 30 is fitted under the handguard 50. Thus, it should be appreciated that the position of the support ring registration notch 129 may be positioned at any point along the body of the suppressor 30. For example, the support ring registration notch 129 may be positioned proximate the rear of suppressor 30 if the suppressor 30 will not be mounted under the handguard 50 (or the rear portion of the suppressor 30 is not otherwise obstructed), so that the installed suppressor heat shield 110 covers all or substantially all of the suppressor 30.

Once the support ring elements 121 are appropriately positioned, the suppressor heat shield 110 is aligned with the suppressor 30 and the suppressor core 20 and a portion of the suppressor 30 is positioned through the internal cavity 115 of the suppressor heat shield 110. The suppressor heat shield 110 continues to be urged toward the support ring elements 121 until the external threads 122 of the support ring elements 121 are able to interact with the internal threads of the internally threaded portion 117 of the suppressor heat shield 110.

Interaction of the internally threaded portion 117 of the suppressor heat shield 110 and the external threads 122 of the support ring elements 121 allows the suppressor heat shield 110 to the threadedly attached or coupled to the support ring elements 121. The external threads 122 of the support ring elements 121 are able to threadedly interact with the internally threaded portion 117 of the suppressor heat shield 110 until a surface of the support ring element 121 is abutted against the heat shield shoulder 118 of the internal projection.

When the suppressor heat shield 110 is appropriately attached or coupled to the support ring elements 121, the heat shield cap 130 is positioned so that the cap shoulder 134 of the heat shield cap 130 is abutted against the terminating surface of the second end 112 of the suppressor heat shield 110. The heat shield cap 130 may optionally be rotated so that one or more gas apertures 136 of the heat shield cap 130 are appropriately aligned with one or more suppressor gas apertures 32.

When the heat shield cap 130 is appropriately positioned relative to the suppressor heat shield 110, the heat shield nut 140 is aligned with the suppressor core 20, such that the internally threaded recess 144 of the heat shield nut 140 is able to threadedly interact with the suppressor core external threads 22. By interaction of the suppressor core external threads 22 and the internally threaded recess 144 of the heat shield nut 140, the heat shield nut 140 can be rotated to secure the elements of the suppressor heat shielding system 100 to the suppressor 30 and suppressor core 20. In various exemplary embodiments, the internally threaded recess 144 includes a stop so that the heat shield nut 140 cannot be over threaded relative to the suppressor core 20. The interaction of the heat shield cap 130 and the suppressor heat shield 110 maintains the front portion of the suppressor heat shield 110 in position relative to the suppressor 30.

Because of the configuration of the suppressor heat shielding system 100, airflow can be created within the internal cavity 115 of the suppressor heat shield 110 between the support ring air gaps 127 and the gas apertures 136 of the heat shield cap 130. This results in the creation of a 'stack effect' or 'chimney effect' by the temperature and pressure difference between the comparatively warmer air within the cavity of the suppressor heat shielding system 100 and comparatively cooler, ambient temperature air outside the suppressor heat shielding system 100, as hot air rises and draws in cooler air from outside. When the firearm is elevated or lowered, a 'stack effect' is induced similar to that of a chimney or flue system.

Thus, due to the chimney like nature of the design, when the firearm is pointed generally upward or downward, cooler, ambient air from outside the suppressor heat shield 110 is drawn in at the bottom-most end, as the heat rises. This results in an efficient cooling system as the cooler air is drawn into the cavity of the suppressor heat shield 110 (either through the one or more support ring air gaps 127 or the gas apertures 136—depending on which end is pointed downward) and directed along the entire length of the suppressor 30, where continuous convective heat transfer results in effective cooling. Here cooler atmospheric air moves into the internal cavity 115 at either its first end 111 or second end 112 (depending on orientation) and a positive buoyancy force is created. Warm air is moved up the suppressor heat shield 110 while cool air enters. This creates a very efficient draft of cooling air across the interior surface 114 of the suppressor heat shield 110 and the exterior surface of the suppressor 30 and decreases cooling time. This flow of air is generated regardless of whether the firearm is pointed upward or downward.

Additionally, during a firing cycle, as propellant gases pass through the central borehole 142, the gas apertures 136, and/or the slots 147, a vacuum is created to draw propellant gases through the internal cavity 115 of the suppressor heat shield 110. The forward flowing gases also create a Venturi effect, drawing additional air from outside the suppressor heat shield 110, through the internal cavity 115, and over the exterior surface of the suppressor 30.

Thus, as air moves through the internal cavity 115, fresh, outside, ambient air is drawn into the internal cavity 115 of the suppressor heat shield 110 behind it. The suppressor heat shielding system 100 provides both active airflow through the internal cavity 115 (every time the firearm is fired, air is drawn through the internal cavity 115) and passive airflow (when the firearm is positioned slightly upward or downward, thermal rise of heat within the internal cavity 115 draws air through the internal cavity 115.

Figure 4:
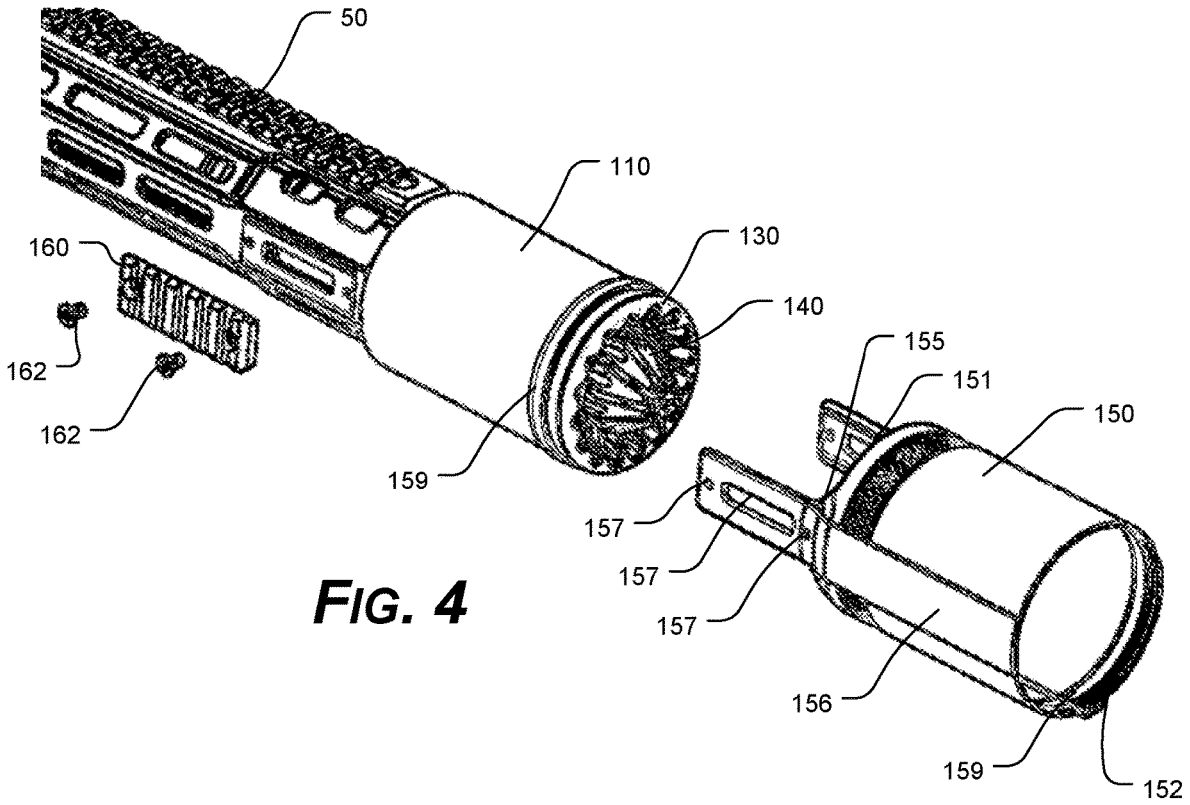
FIG. 4 illustrates an upper, front, perspective view of an exemplary heat shield cover aligned with an exemplary suppressor heat shield, according to the present disclosure.
Figure 5:
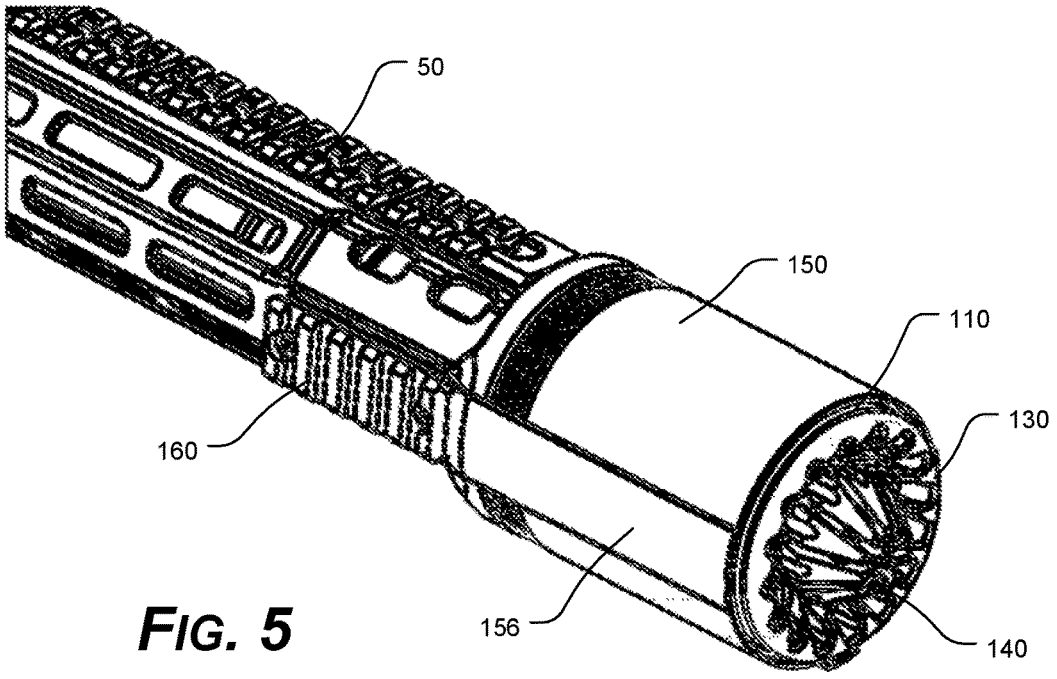
FIG. 5 illustrates an upper, front, perspective view of an exemplary heat shield cover attached or coupled to an exemplary handguard and at least partially surrounding an exemplary suppressor heat shield, according to the present disclosure.

FIGS. 4-5 illustrate an exemplary embodiment of a heat shield cover 150, according to the present disclosure. As illustrated in FIGS. 4-5, the heat shield cover 150 extends from a first end 151 to a second end 152 and is designed so as to operate with or without a suppressor heat shield 110. As illustrated, the heat shield cover 150 is utilized in combination with a suppressor heat shield 110. The suppressor heat shield 110 includes the elements described herein.

The heat shield cover 150 optionally includes an extension portion 155 that extends from the first end 151. The extension portion 155, if included, is formed so as to extend toward, and optionally at least partially around a portion of the handguard 50 to create a better seal between the handguard 50 in the heat shield cover 150.

The heat shield cover 150 provides a cover or open-ended "sock" that is able to cover all or at least a portion of the suppressor heat shield 110. The heat shield cover 150 may be formed of a fabric or other material.

The heat shield cover 150 further comprises an attachment strap element 156 that is attached or coupled to an outer surface of the heat shield cover 150 and extends rearward so that the attachment strap element 156 may be attached or coupled to a portion of the handguard 50. Because of cooler exterior temperature of the suppressor heat shield 110, Velcro or other attachment element(s) 159 can be adhesively attached or coupled to an exterior of the suppressor heat shield 110 and a mating attachment element 159 can be positioned within the heat shield cover 150. The heat shield cover 150 can then be placed over the exterior of the suppressor heat shield 110 to act as signature reduction (IR) or visual reduction (camouflage fabric).

In various exemplary embodiments, the attachment strap element 156 is attached or coupled to the handguard 50 via interaction of fastener elements 162 (such as blots or screws), attachment aperture(s) 157 formed in the attachment strap element 156, and apertures formed in the handguard 50.

The attachment strap elements 156 may also be used to retain the heat shield cover 150 in place relative to the handguard 50. The attachment strap elements 156 attach to the handguard 50, while retaining the heat shield cover 150 in place.

In certain exemplary embodiments, the attachment strap elements 156 provide attachment points along their respective lengths using a 'molle' or similar attachment system. Additionally, attachable rail segments 160 may also be attached or coupled, via the fastener elements 162.

While the present disclosure has been described in conjunction with the exemplary embodiments outlined above, the foregoing description of exemplary embodiments, as set forth above, are intended to be illustrative, not limiting and the disclosure should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A suppressor heat shielding system, comprising:

a suppressor heat shield extending from an open first end to an open second end and having an internal cavity, wherein said internal cavity is sized to allow at least a portion of a suppressor to be at least partially contained within said internal cavity, wherein a sealed heat shield cavity is formed between at least a portion of an interior surface and at least a portion of an exterior surface of said suppressor heat shield, and wherein a vacuum is created within said heat shield cavity;

an externally threaded support ring attached or coupled to said first open end of said suppressor heat shield, wherein one or more support ring air gaps are formed through said support ring element;

a heat shield cap abutted against said open second end of said suppressor heat shield, wherein one or more gas apertures are formed through said heat shield cap; and a heat shield nut abutted against at least a portion of said heat shield cap.

2. The suppressor heat shielding system of claim 1, wherein said externally threaded support ring comprises two aligned externally threaded support ring elements.

3. The suppressor heat shielding system of claim 1, wherein said suppressor heat shield is formed of stainless steel.

4. The suppressor heat shielding system of claim 1, further comprising a heat shield cover positioned around at least a portion of said suppressor heat shield, wherein said heat-shield cover is at least partially attached to a handguard.

5. The suppressor heat shielding system of claim 1, wherein each of said support ring elements includes one or more inwardly extending protrusions that extend from said support ring element, away from said external threads and wherein each of said one or more gas apertures is formed at least partially between said one or more inwardly extending protrusions.

6. The suppressor heat shielding system of claim 1, wherein said support ring elements are aligned with a support ring registration notch formed in at least a portion of a suppressor and positioned such that terminating end portions of said inwardly extending protrusions are seated within at least a portion of said support ring registration notch.

7. The suppressor heat shielding system of claim 1, wherein at least a portion of said suppressor heat shield is double-walled.

8. The suppressor heat shielding system of claim 1, wherein said one or more gas apertures are formed so as to be aligned with one or more suppressor gas apertures of a suppressor.

9. A suppressor heat shielding system, comprising:

a suppressor heat shield having an internal cavity formed therethrough, wherein said internal cavity is sized to allow at least a portion of a suppressor to be positioned within said internal cavity, wherein said suppressor heat shield includes a sealed heat shield cavity formed therein, and wherein a vacuum is created within said heat shield cavity;

an externally threaded support ring threadedly attached or coupled to an open first open end of said suppressor heat shield, wherein one or more support ring air gaps are formed through said support ring element;

a heat shield cap abutted against an open second end of said suppressor heat shield, wherein one or more gas apertures are formed through said heat shield cap; and a heat shield nut abutted against at least a portion of said heat shield cap.

10. The suppressor heat shielding system of claim 9, wherein said externally threaded support ring comprises two aligned externally threaded support ring elements.

11. The suppressor heat shielding system of claim 9, wherein said suppressor heat shield is formed of stainless steel.

12. The suppressor heat shielding system of claim 9, further comprising a heat shield cover positioned around at least a portion of said suppressor heat shield, wherein said heatshield cover is at least partially attached to a handguard.

13. The suppressor heat shielding system of claim 9, wherein each of said support ring elements includes one or more inwardly extending protrusions that extend from said support ring element, away from said external threads and wherein each of said one or more gas apertures is formed at least partially between said one or more inwardly extending protrusions.

14. The suppressor heat shielding system of claim 9, wherein said support ring elements are aligned with a support ring registration notch formed in at least a portion of a suppressor and positioned such that terminating end portions of said inwardly extending protrusions are seated within at least a portion of said support ring registration notch.

15. The suppressor heat shielding system of claim 9, wherein said one or more gas apertures are formed so as to be aligned with one or more suppressor gas apertures of a suppressor.

16. A suppressor heat shielding system, comprising:

a suppressor heat shield having an internal cavity formed therethrough, wherein said internal cavity is sized to allow a suppressor to be positioned within said internal cavity, wherein said suppressor heat shield includes a sealed heat shield cavity formed therein, wherein a vacuum is created within said heat shield cavity, and wherein an internally threaded portion is formed in a portion of said suppressor heat shield extending from an open first end of said suppressor heat shield;

an externally threaded support ring threadedly attached or coupled to said internally threaded portion of said suppressor heat shield, wherein one or more support ring air gaps are formed through said support ring element.

17. The suppressor heat shielding system of claim 16, wherein said externally threaded support ring comprises two aligned externally threaded support ring elements.

18. The suppressor heat shielding system of claim 16, further comprising a heat shield cap abutted against an open second end of said suppressor heat shield, wherein one or more gas apertures are formed through said heat shield cap.

19. The suppressor heat shielding system of claim 18, further comprising a heat shield nut abutted against at least a portion of said heat shield cap.

20. The suppressor heat shielding system of claim 16, further comprising a heat shield cover positioned around at least a portion of said suppressor heat shield, wherein said heatshield cover is at least partially attached to a handguard.

* * * * *